US006407709B1

(12) United States Patent
Hanshew

(10) Patent No.: US 6,407,709 B1
(45) Date of Patent: Jun. 18, 2002

(54) MOUNTING DEVICE WITH INTEGRATED ANTENNA

(75) Inventor: Christopher Hanshew, Lenexa, KS (US)

(73) Assignee: Garmin Corporation (TW)

( * ) Notice: Subject to any disclaimer, the term of this patent is extended or adjusted under 35 U.S.C. 154(b) by 0 days.

(21) Appl. No.: 09/354,871

(22) Filed: Jul. 16, 1999

(51) Int. Cl.[7] ..... H01Q 1/24

(52) U.S. Cl. ..... 343/702; 343/705; 343/713; 343/872; 343/895

(58) Field of Search ..... 343/702, 895, 343/872, 878, 892, 906, 700 MS, 705, 711, 713, 718

(56) References Cited

U.S. PATENT DOCUMENTS

| | | | | | |
|---|---|---|---|---|---|
| 3,798,651 | A | | 3/1974 | Lehman | 343/702 |
| 3,802,653 | A | | 4/1974 | Nyulassie | 248/43 |
| 4,270,721 | A | | 6/1981 | Mainor, Jr. | 248/285 |
| D302,160 | S | | 7/1989 | Egashira | D14/238 |
| 5,204,817 | A | | 4/1993 | Yoshida | 364/449 |
| 5,283,589 | A | | 2/1994 | Blevins | 343/715 |
| D348,886 | S | | 7/1994 | Watanabe | D14/238 |
| D350,137 | S | | 8/1994 | Watanabe | D14/238 |
| 5,353,040 | A | | 10/1994 | Yamada et al. | 343/895 |
| 5,456,442 | A | | 10/1995 | Sutton et al. | 248/534 |
| 5,502,452 | A | * | 3/1996 | Gomez | 343/872 |
| 5,512,912 | A | | 4/1996 | Ross et al. | 343/765 |
| 5,564,083 | A | | 10/1996 | Lee et al. | 455/90 |
| 5,606,732 | A | * | 2/1997 | Vicnone, Sr. | 343/702 |
| 5,619,217 | A | | 4/1997 | Mailandt et al. | 343/872 |
| 5,742,256 | A | | 4/1998 | Wakabayashi | 343/718 |
| 5,760,748 | A | | 6/1998 | Beckingham | 343/765 |
| 5,798,882 | A | | 8/1998 | Lang | 359/872 |
| 5,838,281 | A | | 11/1998 | Blaese | 343/715 |
| 5,874,920 | A | | 2/1999 | Araki et al. | 343/702 |
| 5,898,408 | A | | 4/1999 | Du | 343/715 |
| 5,943,018 | A | * | 8/1999 | Miller | 343/702 |
| 5,945,950 | A | | 8/1999 | Elbadawy | 343/700 |
| 5,945,956 | A | | 8/1999 | Izawa et al. | 343/713 |
| 5,947,359 | A | | 9/1999 | Yoshie | 224/570 |
| 5,990,846 | A | * | 11/1999 | Dichter | 343/872 |
| 6,023,245 | A | * | 2/2000 | Gomez et al. | 343/700 MS |
| 6,091,368 | A | * | 7/2000 | Mitchell et al. | 343/906 |
| 6,097,339 | A | * | 8/2000 | Filipovic et al. | 343/700 MS |
| 6,107,970 | A | * | 8/2000 | Holshouser et al. | 343/702 |
| 6,133,886 | A | * | 10/2000 | Fariello et al. | 343/702 |
| 6,154,184 | A | * | 11/2000 | Endo et al. | 343/895 |

* cited by examiner

*Primary Examiner*—Don Wong
*Assistant Examiner*—Thuy Vinh Tran
(74) *Attorney, Agent, or Firm*—Devon A. Rolf

(57) ABSTRACT

A mount for mounting an electronic device, such as a GPS device, has an integrated antenna. In particular, the mount includes a mounting bracket and a base, to which the mounting bracket is adjustably secured. The mounting bracket has an antenna housing at an upper portion thereof, wherein the antenna housing is formed by a cavity integrally molded in the mounting bracket and a cap for positioning over the cavity. A cylindrical, helical antenna is positioned in the cavity, and the cap is releasably secured over the antenna to the periphery of the cavity. A co-axial cable connects the antenna to an electrical connector, also located on the mounting bracket. The electrical connector is adapted to connect with a corresponding electrical connector on an electronic device to which the mount is attached.

19 Claims, 1 Drawing Sheet

MOUNTING DEVICE WITH INTEGRATED ANTENNA

BACKGROUND OF THE INVENTION

1. Field of the Invention

The present invention is directed to a mount for an electronic device. In particular, the present invention is directed to a mount having an integrally formed antenna housing.

2. Description of the Related Art

Many conventional electronic devices which utilize one or more signals from an external source require a remotely mounted external antenna. For example, typical fixed-mount marine GPS units utilize such a remote mounted external antenna, which is usually mounted on a pole. The antenna is then connected to the GPS unit by means of a coaxial cable. As will be appreciated, in many instances, such an arrangement is unnecessary as well as cumbersome.

Accordingly, the need exists for a mount for mounting an electronic device, such as a GPS unit or other unit which requires signals from a remote source, having an antenna housing integrated therein. Such a device would alleviate the need to install a remote antenna or route cable, as is required with the prior art The present invention fills these and other needs, while overcoming the drawbacks of the prior art.

SUMMARY OF THE INVENTION

It is the principal object of the present invention to integrate a mount and an antenna.

This and other objects are achieved by a mount for an electronic device having all, or at least a portion of, an antenna housing integrally formed therein. Preferably, the mount is formed of molded plastic.

In a preferred embodiment, the mount has a mounting bracket portion which includes an integral antenna housing, and a base portion which is adjustably attached thereto. In particular, the antenna housing forms a cavity which receives an antenna. In a preferred embodiment, the antenna is a cylindrical, helical antenna, although other types of antennas may be utilized and are within the scope of the present invention. The antenna housing further includes a cap, which is then secured over the cavity having the antenna positioned therein. In a preferred embodiment, an exterior upper rim of the antenna housing, and an inner portion of the cap, are threaded, so that the cap may be screwed into place. Other manners of connecting the cap in place may be utilized.

At a location on the mounting bracket that is remote from the antenna housing, an electrical connector is provided. This electrical connector is adapted to connect with an electrical connector on the electronic device to which the mounting bracket will be secured. A co-axial cable connects the antenna, positioned in the antenna housing, to the connector.

In a preferred embodiment, the mounting device is used in combination with a GPS unit. More particularly, the mounting device is utilized in conjunction with a marine GPS unit which further has sonar depth sounding (e.g., fish finding) capabilities. As will be appreciated, the mount can be utilized, or adapted for use, with other types of electronic devices.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

With reference now to the figures, the present invention, as illustrated, is directed to a mount for mounting an electronic device. The mount incorporates an integrated antenna housing, for housing an antenna.

Figure 1:
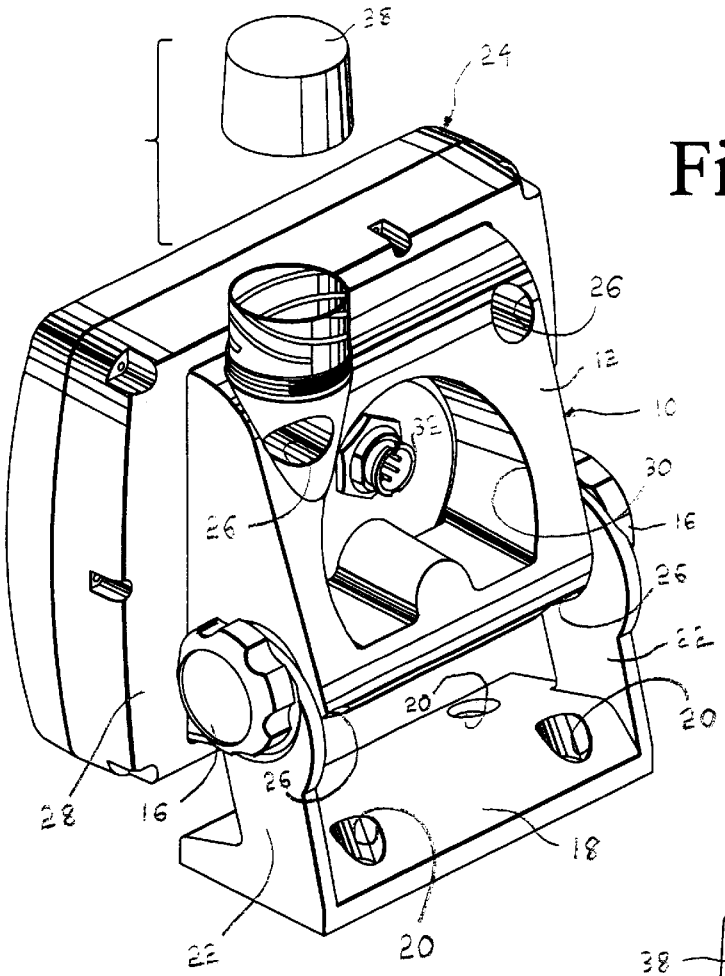
FIG. 1 is a rear perspective view of the mount of the present invention, illustrated as connected to an electronic device.
Figure 2:
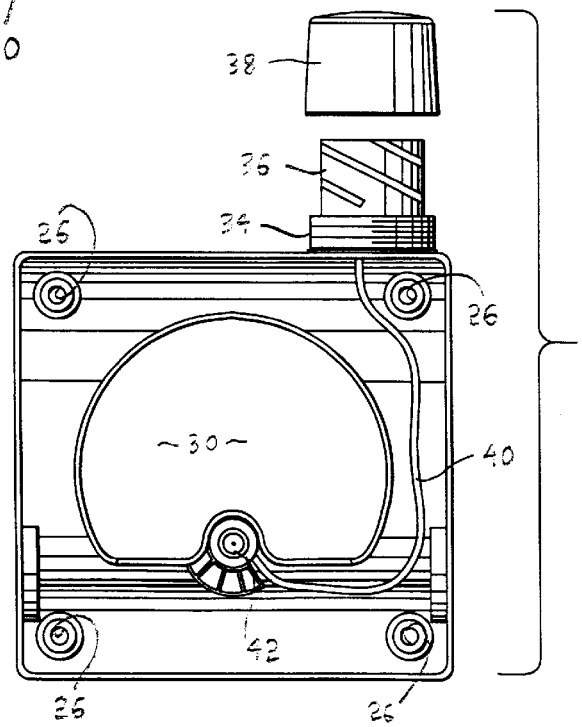
FIG. 2 is an elevational view of a portion of the mount of the present invention, illustrated from a side of the mount which connects to an electronic device.

In particular, with reference to FIGS. 1 and 2, a mount of the present invention is denoted generally by reference numeral 10. Mount 10 has a mounting portion, namely, a bracket, denoted generally by reference numeral 12. The mounting bracket 12 is positioned on a base 14. Preferably, mounting bracket 12 is integrally formed of plastic, although other suitable materials may be utilized.

Base 14 may also be formed of plastic, or other suitable materials, such as metal. Mounting bracket 12 is adjustably mounted to base 14 in a conventional fashion. Adjustment knobs 16 may be utilized to position the mounting bracket in a desired location.

Base 14 has a foundation 18 having a plurality of openings 20 therein. As will be appreciated, openings 20 receive fasteners (not shown) for fastening the mount 10 to a surface, such as the deck of a marine craft. Base 14 also has a pair of upwardly extending arms 22 at opposite ends thereof. As illustrated, arms 22 are releasably secured to mounting bracket 12. Mounting bracket 12 is adapted for, and as illustrated is, connected to an electronic device 24. In particular, mounting bracket 12 has a plurality of openings 26 for receiving fasteners (such as screws) which pass through the openings 26 and into corresponding openings (not shown) in the rear of housing 28 of electronic device 24.

More particularly, mounting bracket 12 forms a substantially square or rectangular housing having a central opening 30 therein. As illustrated, central opening 30 exposes a selected portion of the electronic device. In particular, central opening 30 exposes an electrical connector 32 of the electronic device 24.

Further, bracket portion 12 has an integrally formed antenna housing 34. Preferably, antenna housing 34 is located at an upper portion of bracket 12, and is cylindrical in nature. It will be appreciated that antenna housing 34 may be located at other portions of the mount 10, and need not be cylindrical. In the preferred embodiment illustrated, the cylindrical housing 34 receives a cylindrical, helical antenna 36. In particular, a portion of antenna 36 is snugly received within the cavity formed by antenna housing 34, while a remaining portion of antenna 36 extends upwardly from the cavity formed by antenna housing 34. Additionally, a cap 38, forming part of the antenna housing, is provided. Cap 38 is adapted to cover that portion of antenna 36 extending upwardly from the cavity formed by antenna housing 34. The antenna housing 34 forms an annular rim. Preferably, cap 38 releasably secures to the annular rim of the antenna housing 34. As illustrated, this is accomplished by a threaded arrangement. However, other fastening techniques could be utilized.

Additionally, as illustrated in FIG. 2, a co-axial cable 40 connects antenna 36 to an electrical connector 42 located on the mounting bracket 12, but remotely from the antenna housing 34. Electrical connector 42 on the mounting bracket is adapted to connect with an electrical connector (not shown) on the electronic device 24.

In use, base 14 of mount 10 is mounted to a desired surface, such as the deck of a marine craft. Mounting bracket 12 is secured -to an electronic device 24, such as a GPS device, or combination GPS/sonar depth sounder device, and the combination thereof is secured to base 14 and adjusted by adjusting knobs 16, to a desired position. In particular, electrical connector 42 of mounting bracket 12 is connected to an exposed electrical connector on electronic device 24. Thus, electronic device 24, which requires signals obtained from a remote location, such as GPS signals obtained from a plurality of orbiting satellites, receives these signals through antenna 36 which is integrally mounted in the mounting device, thus relieving the user from separately mounting and wiring a remote antenna.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A mount for mounting a portable electronic device to a vehicle or vessel, said mount comprising:

a mounting portion having a first portion for coupling with the vehicle or vessel and a second portion to which said electronic device can be releasably mounted;

an antenna housing wherein at least a portion of said antenna housing is integrally formed with said mounting portion; and an antenna positioned in said antenna housing, wherein the electronic device is electrically connected to said antenna when the electronic device is secured to said second portion, and wherein the electronic device is disconnected from said antenna when the electronic device is released from said second portion.

2. The mount as set forth in claim 1, wherein said antenna is a helical antenna.

3. The mount as set forth in claim 1, wherein said antenna housing further comprises a cap.

4. The mount as set forth in claim 3, wherein said antenna housing comprises:

a cylindrical housing having an open end for receiving a cylindrical antenna; and a removable cap for covering said open end of said cylindrical housing.

5. The mount as set forth in claim 1 further comprising a connector positioned remotely from said antenna housing, said connector for connecting electrically with said electronic device.

6. The mount as set forth in claim 5, further comprising a cable connecting said antenna and said connector.

7. The combination as set forth in claim 1, wherein said electronic device has an electronic receiver connected to an electrical connector, wherein said electrical connector connects with said connector of said mounting portion.

8. The combination as set forth in claim 7, wherein said electronic device comprises a GPS unit.

9. The combination as set forth in claim 8, wherein said electronic device further comprises a sonar depth sounder.

10. The mount as set forth in claim 1, wherein said mounting portion comprises:

a bracket; and a base connected to said bracket.

11. The mount as set forth in claim 10, wherein said base is adjustably connected to said bracket.

12. The mount as set forth in claim 10, wherein said bracket has an open area for exposing a selected portion of the electronic device to which said bracket is mounted.

13. The mount as set forth in claim 1, wherein said mount is at least partially constructed of plastic.

14. The mount as set forth in claim 13, further comprising means for attaching said mount to said electronic device.

15. A mount for mounting a portable electronic device to a vehicle or vessel, said electronic device having a front face, a rear face and a display, said mount comprising:

a mounting portion, said mounting portion having a surface to which said electronic device can be releasably mounted, wherein said rear face of said electronic device engages said surface of said mounting portion when said electronic device is mounted on said mounting portion;

an antenna housing located on said mounting portion, wherein at least a portion of said antenna housing is integral with said mounting portion;

an antenna positioned in said antenna housing; and a connector for connecting said antenna with said electronic device, wherein the portable electronic device is electrically connected to said antenna via said connector when the electronic device is secured to said mounting portion, and wherein the electronic device is disconnected from said antenna when the electronic device is released from said mounting portion.

16. The mount as set forth in claim 15, wherein said surface of said mounting portion further includes an opening.

17. The mount as set forth in claim 15, wherein said antenna housing is located proximate a top of said mounting portion.

18. The mount as set forth in claim 17, wherein said antenna housing includes a cavity for receiving said antenna, said mount further comprising a cap for positioning over said antenna when said antenna is located in said cavity.

19. An adaptor for releasably mounting a portable electronic device to a vehicle or vessel, the portable electronic device having a housing and a display, said adaptor comprising:

a mounting portion having a bracket and a base, wherein said base is for coupling to the vehicle or vessel, and wherein said bracket is connected to said base and has a surface for releasably securing the device to said mounting portion, an antenna housing wherein at least a portion of said antenna housing is formed integrally with the bracket;

an antenna positioned in said antenna housing; and a connector for connecting said antenna with said electronic device, wherein the portable electronic device is electronically connected to said antenna when the electronic device is secured to said mounting portion, and wherein the electronic device is disconnected from said antenna when the electronic device is released from said mounting portion.

* * * * *